US005445656A

United States Patent [19]

Marelli

[11] Patent Number: 5,445,656

[45] Date of Patent: Aug. 29, 1995

[54] DIESEL FUEL EMULSION

[76] Inventor: Ernesto Marelli, Via Frisia 29, 22055 Merate (Province of Como), Italy

[21] Appl. No.: 121,834

[22] Filed: Sep. 16, 1993

Related U.S. Application Data

[63] Continuation of Ser. No. 807,661, Dec. 16, 1991, abandoned, which is a continuation of Ser. No. 442,881, Nov. 29, 1989, abandoned.

[30] Foreign Application Priority Data

Dec. 5, 1988 [IT] Italy ..... 22589/88

[51] Int. Cl.[6] ..... C10L 1/12

[52] U.S. Cl. ..... 44/301; 44/302

[58] Field of Search ..... 44/301, 302

[56] References Cited

U.S. PATENT DOCUMENTS

| | | | |
|---|---|---|---|
| 4,199,326 | 4/1980 | Fung | 44/301 |
| 4,378,230 | 3/1983 | Rhee | 44/301 |
| 4,477,258 | 10/1984 | Lepain | 44/302 |
| 4,666,457 | 5/1987 | Hayes et al. | 44/301 |
| 4,804,495 | 2/1989 | Bouchez et al. | 44/301 |
| 4,877,414 | 10/1989 | Mekonen | 44/51 |
| 4,911,736 | 3/1990 | Huang et al. | 44/301 |
| 5,372,613 | 12/1994 | Mekonen | 44/301 |

FOREIGN PATENT DOCUMENTS 0124061 11/1984 European Pat. Off. .

*Primary Examiner*—Jerry D. Johnson

*Attorney, Agent, or Firm*—Guido Modiano; Albert Josif

[57] ABSTRACT

The present invention relates to a fuel for reducing the noxiousness of exhaust gases, particularly for internal-combustion engines. The fuel has the peculiarity of comprising a mixture of a combustible fuel with 10 to 42% water by weight with respect to the combustible fuel, with the addition of a lubricating antifreeze activator in an amount comprised between 0.5 and 2% by weight of the amount of combustible fuel. The mixture is atomized and stabilized by means of a turbine transducer which provides an electro-magneto-mechanical action, subjecting the mixture, in succession, to positive-pressure actions alternated with negative-pressure actions at high frequency.

1 Claim, 2 Drawing Sheets

20
21
22
23
25
26
27
30
31
32
33
40

DIESEL FUEL EMULSION

This is a continuation application of application Ser. No. 07/807,661 filed on Dec. 16, 1991, now abandoned; which in turn is a continuation of application Ser. No. 07/442,881 filed on Nov. 29, 1989, now abandoned.

BACKGROUND OF THE INVENTION

The present invention relates to a fuel for reducing the noxiousness of exhaust gases, particularly for internal-combustion engines.

The Italian patent no. 1,168,927 in the name of the same Applicant, included herein as reference, discloses an apparatus for the emulsifying and atomization of fluid fuels with secondary fluids, for example water. Said apparatus substantially comprises a turbine transducer which defines a cavitation chamber in which a fluid fuel and water are introduced in order to emulsify and atomize them. In said cavitation chamber, the fluids are subjected to a combined mechanical and electromagnetic action which produces, inside said chamber, a collimated corridor which is traversed by the fuel and by the water mixed together, so as to obtain an intimate mixing of the two components, for feeding burners or the like, reducing the fuel used, for an equal energy effect, as well as reducing the noxiousness of the exhaust gases.

This apparatus was expressly provided for fixed systems, such as industrial and/or heating systems and the like, but was scarcely suitable for use in engines for motor vehicles and the like, since the atomized product obtained between fuel and water was, when used with Diesel fuel, scarcely stable, with the consequent need to use it immediately after its production.

SUMMARY OF THE INVENTION

The aim of the invention is indeed to eliminate the above described limitation by providing a fuel for reducing the noxiousness of exhaust gases, particularly for internal-combustion engines, which has great characteristics of emulsion stability, thus allowing its use on motor vehicles and the like.

Within the scope of the above described aim, a particular object of the invention is to provide a fuel which can be produced directly on board the motor vehicle or the system, and remotely from the users, since it preserves its stability characteristics.

Another object of the present invention is to provide a non-polluting fuel, in particular for Diesel engines in general, but also usable with fuels different from Diesel fuel, which can be introduced directly into the fuel tank with no modification of the engine system.

The above described aim, the objects mentioned and others which will become apparent hereinafter are achieved by a fuel for reducing the noxiousness of exhaust gases, particularly for internal-combustion engines, according to the invention, as defined in the appended claims.

BRIEF DESCRIPTION OF THE DRAWINGS

Further characteristics and advantages will become apparent from the description of a fuel for reducing the noxiousness of exhaust gases, of the unit for feeding the fuel to the engine of a vehicle and of a fuel distribution system, illustrated only by way of non-limitative example in the accompanying drawings, wherein.

DESCRIPTION OF THE PREFERRED EMBODIMENTS

Figure 1:
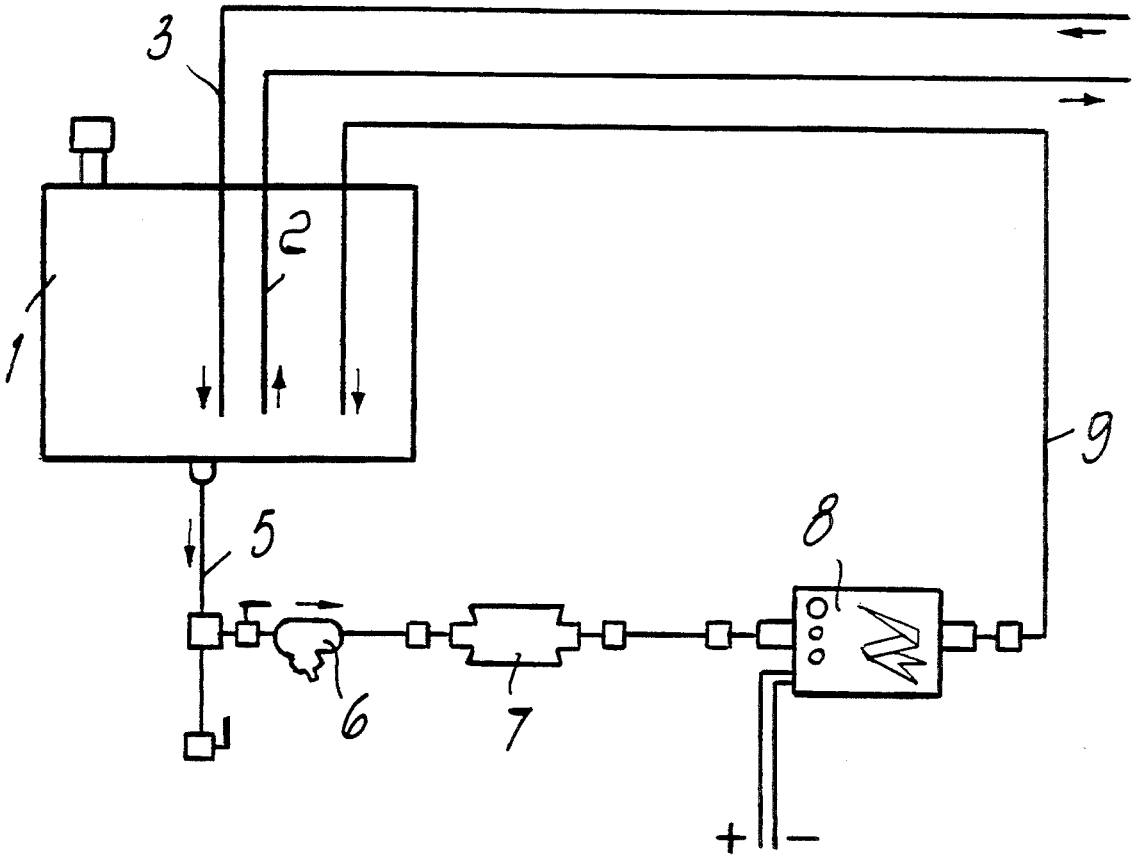
FIG. 1 is a conceptual diagram of the unit for feeding fuel to a motor vehicle.

With reference to the above described figures, the fuel for reducing the noxiousness of exhaust gases, in particular for internal-combustion engines, has the peculiarity of being constituted by a mixture of a combustible fuel with water in a percentage which may be comprised between 10 and 42% by weight with respect to the combustible fuel.

The combustible fuel is preferably but not necessarily ordinary, extra-light or heavy Diesel fuel, usable for Diesel engines, but can also be a fuel different from Diesel fuel, for example for feeding gasoline-fueled internal-combustion engines.

The water used can be ordinary mains water with any degree of hardness, so long as it is filtered, with a temperature which can reach up to 35°/40° C.

An important aspect, in order to obtain the stability of the emulsion which must be provided, is constituted by the addition of an emulsion stabilizer which is a lubricating antifreeze activator in an amount comprised between 0.5 and 2% by weight of the amount of combustible fuel.

Experimental tests carried out have shown that activators such as sorbitol and/or sorbitan mono-oleate POE are particularly suitable; among these, the product SORBIROL MEC W4, marketed "ad hoc" by AUSCHEM, with carbon atoms and polyhedral structure, has been found to be particularly suitable. This lubricating activator is dispersible in water and produces $CO_2$ and CO during combustion.

The lubricating antifreeze activator and the water can be poured separately or pre-combined into the combustible fuel, so as to obtain a mixture which is then atomized and stabilized in a transducer which is conceptually analogous to the one illustrated in the above mentioned patent, which causes instantaneous atomization and stabilizes the mixture, allowing to use it even after a long period of time.

The transducer has a main cavitation chamber which acts on the flowing fluid mixture by means of electromagneto-mechanical actions, subjecting it to moments of positive pressure followed by moments of negative pressure, at high frequency.

The fuel obtained allows to feed aspirated engines and direct- or indirect-injection engines, preserving operating conditions for the engine which are substantially identical to operating conditions using conventional fuels.

According to typical operating conditions, it is possible to install on the motor vehicle a fuel feed unit which has, according to the general conceptual diagram, a tank 1 from which draws a first duct 2 for feeding fuel to the engine and a second duct 3 for returning the fuel to the tank.

A fuel recycling circuit is furthermore provided and has an outlet duct 5 on which a protection filter 6 is arranged ahead of an electric pump 7 which feeds the fuel into a turbine transducer 8; a recycling inlet duct, indicated by 9, is provided on said transducers outlet and returns the fuel to the tank 1.

According to this diagram, the fuel introduced in the tank is continuously subjected to the action of the turbine transducer, preventing sediments or accidental separations of the components.

Figure 2:
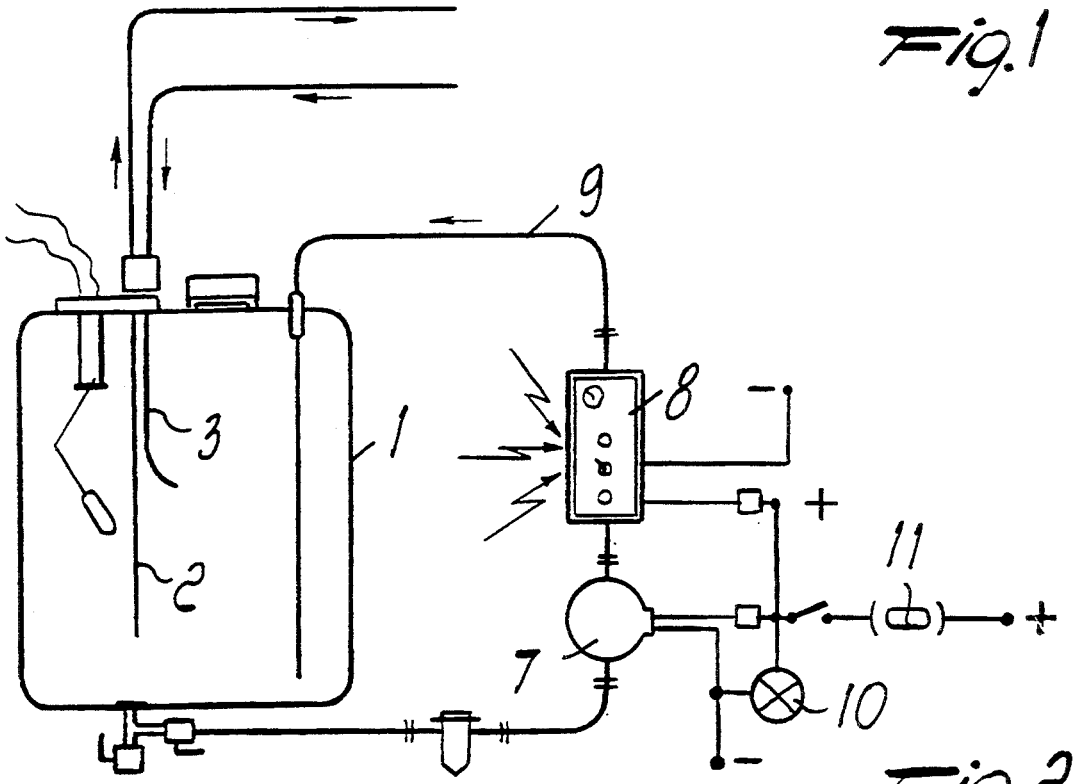
FIG. 2 is a view of a unit for feeding the fuel to a motor vehicle.
Figure 3:
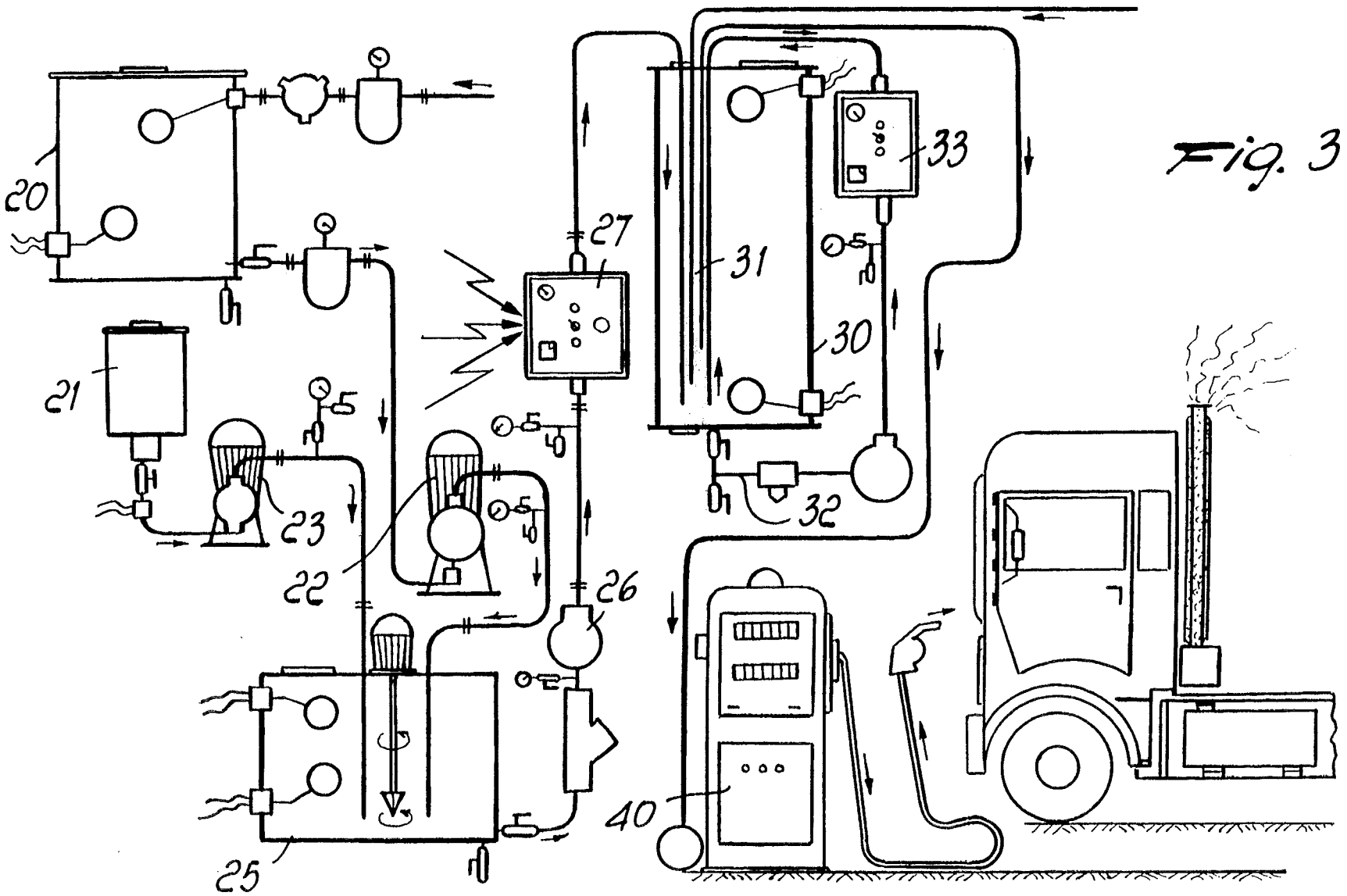
FIG. 3 is a diagram of a system for producing and distributing the fuel, according to the invention.

In the constructive diagram illustrated in FIG. 2, the pump, again indicated by 7, is applied under a pressure head and merely has the function of recycling the fuel through the turbine transducer, again indicated by 8.

A warning light 10, indicating the operation of the turbine transducer, and a conventional fuse 11 for protecting the pump 7 are furthermore provided.

By using the same criterion of execution it is possible to provide a fuel production and distribution system which can be conceptually likened to ordinary fuel pumps.

Said system is constituted by a tank 20 for the water from the mains system, with a level regulator, and by a tank 21 for the lubricating antifreeze activator; a first dosage pump 22 and a second dosage pump 23 are furthermore provided and feed the water and the lubricating antifreeze activator into an activated-water storage tank 25, in which a first pump 26 draws and feeds the water-activator mixture into a first turbine transducer 27 the output or delivery whereof leads into a combustible fuel tank 30 connected to a combustible fuel delivery 31 and provided with a recirculation channel 32 on which a second turbine transducer 33 acts.

The combustible fuel tank is connected to a distributor for the atomized Diesel fuel 40 which can be constituted by the conventional pump for supplying fuel to users.

Experimental tests carried out have shown that by using conventional untreated Diesel fuel a discharge emission of 16.4% $O_2$, 3.3–3.4% $CO_2$, 204 or more ppm CO, 300 ppm $SO_2$ and 1300–1400 or more ppm NOX is obtained, with an exhaust gas temperature of 136°–137° C. at an environmental temperature of 24° C.; opacity oscillated between 45% and 55% up to 97%.

Using a fuel with the addition of 10% water, 16.4–16.3% $O_2$, 3.2% $CO_2$, 125–129 ppm CO were obtained, with an exhaust gas temperature of 120° at an environmental temperature of 24° C.

Using a fuel with 15% water by weight, 16.5% $O_2$, 2.5% $CO_2$, 139 ppm CO, 187 ppm $SO_2$ were obtained, with an exhaust gas temperature of 127° C. at an environmental temperature of 26.6° C.; opacity of about 30%.

Using a fuel with 20% water by weight, 16.6% $O_2$, 3.2% $CO_2$, 184 ppm CO, 160 ppm $SO_2$ were obtained, with an exhaust gas temperature of 122° C. at an environmental temperature of 26.6° C.; opacity of about 7%.

Using a fuel with 24% water by weight, 16.7% $O_2$, 2.4% $CO_2$, 171–158 ppm CO, 160 ppm $SO_2$ were obtained with an exhaust gas temperature of 119°–121° C. at an environmental temperature of 26.4° C.; opacity of about 2%.

In all the above indicated experiments, the NOX values were about 267 and 381 and 415 ppm, and the opacity of the particulates is on the average 4%–7%. It should be noted that the opacity values of the particulates, as well as the CO values, for equal running rates and conditions, if measured after a few hours of operation, drop further due to the self-cleaning which is typical of the atomized emulsion.

Particle variations due to the separation of unburned substances exiting at irregular intervals were in fact observed during the tests.

A considerable elimination of $SO_2$ must also be observed: from the typical value of the sulphur content of Diesel fuel it drops to values well below those which could be deduced due to the smaller amount of Diesel fuel being burned.

From what has been described above it can thus be seen that it is possible to achieve considerable advantages as regards the noxiousness of the exhaust gases, together with an increase in performance, since the fuel has percentages of water.

It should be furthermore noted that the addition of the lubricating antifreeze activator, besides acting as lubricant and antifreeze, also has the function of stabilizing the produced emulsion, consequently allowing its use even long after the fuel production time.

The invention thus conceived is susceptible to numerous modifications and variations, all of which are within the scope of the inventive concept.

All the details may furthermore be replaced with other technically equivalent elements.

In practice, the materials employed, so long as compatible with the specific use, may be varied within wide margins without thereby modifying anything of the present invention.

I claim:

1. A method of preparing a diesel fuel composition in the form of a stable emulsion, comprising the steps of:

a. preparing a mixture of an amount of diesel fuel, an amount of water equal to from 10 to 42% by weight of said amount of fuel, and an amount of lubricating antifreeze activator equal to from 0.5 to 2.0% by weight of said amount of fuel, by pouring the water and the activator in the diesel fuel, said lubricating antifreeze activator being selected from the group consisting in sorbitol mono-oleate, sorbitan mono-oleate and their mixtures;

b. passing said mixture through a turbine transducer which provides an electro-magneto-mechanical action by subjecting said mixture, in succession, to positive-pressure actions alternated with negative-pressure actions at high frequency, thereby obtaining a stable emulsion.

* * * * *